US009312647B2

(12) United States Patent
Bechstein

(10) Patent No.: US 9,312,647 B2
(45) Date of Patent: Apr. 12, 2016

(54) CONNECTION OF A FIRST METAL COMPONENT TO A COVERED SECOND METAL COMPONENT

(71) Applicant: KROMBER & SCHUBERT KG, Wuppertal (DE)

(72) Inventor: Daniel Bechstein, Brackenheim (DE)

(73) Assignee: Kromberg & Schubert KG, Wuppertal (DE)

( * ) Notice: Subject to any disclaimer, the term of this patent is extended or adjusted under 35 U.S.C. 154(b) by 0 days.

(21) Appl. No.: 14/358,240

(22) PCT Filed: Feb. 6, 2013

(86) PCT No.: PCT/EP2013/052271

§ 371 (c)(1),
(2) Date: May 15, 2014

(87) PCT Pub. No.: WO2013/124151

PCT Pub. Date: Aug. 29, 2013

(65) Prior Publication Data

US 2014/0370763 A1 Dec. 18, 2014

(30) Foreign Application Priority Data

Feb. 26, 2012 (DE) ..... 10 2012 003 537
Apr. 18, 2012 (DE) ..... 10 2012 007 870

(51) Int. Cl.

| | |
|---|---|
| ***H01R 24/28*** | (2011.01) |
| ***H01R 4/02*** | (2006.01) |
| ***H01R 4/62*** | (2006.01) |
| ***H01R 13/52*** | (2006.01) |
| ***H01R 43/00*** | (2006.01) |

(Continued)

(52) U.S. Cl.

CPC ..... *H01R 24/28* (2013.01); *H01R 4/023* (2013.01); *H01R 4/625* (2013.01); *H01R 13/52* (2013.01);

(Continued)

(58) Field of Classification Search

CPC ..... H01R 11/12; H01R 4/70; H01R 12/707; H01R 4/625; H01R 43/02; H01R 13/03; H01R 3/00; H01R 2101/00; H01R 2103/00; H01R 2201/26

USPC ..... 439/887, 884, 730

See application file for complete search history.

(56) References Cited

U.S. PATENT DOCUMENTS 4,721,474 A * 1/1988 Kanno ..... H01B 7/0063 29/858
6,666,732 B1 * 12/2003 Endacott ..... H01R 4/187 439/730

(Continued)

FOREIGN PATENT DOCUMENTS

DE 3442131 A1 5/1986
DE 102004062457 A1 11/2005

(Continued)

OTHER PUBLICATIONS

International Search Report PCT/ISA/210 for International Application No. PCT/EP2013/052271 Dated May 10, 2013.

(Continued)

*Primary Examiner* — Abdullah Riyami
*Assistant Examiner* — Justin Kratt
(74) *Attorney, Agent, or Firm* — Harness, Dickey & Pierce, P.L.C.

(57) ABSTRACT

The invention relates to a connection between a first metal component and a second metal component covered by a sheath. The first and the second metal component are connected to one another by means of a welded connection. In each case, a partial region of the first metal component and a partial region of the second metal component that comprises at least one section of the sheath are enclosed by a layer of insulating material that is applied.

15 Claims, 2 Drawing Sheets

(51) Int. Cl.

| | |
|---|---|
| *H01R 103/00* | (2006.01) |
| *H01R 12/70* | (2011.01) |
| *H01R 4/70* | (2006.01) |
| *H01R 11/12* | (2006.01) |
| *H01R 43/02* | (2006.01) |

(52) U.S. Cl.
CPC ..... *H01R 43/005* (2013.01); *H01R 43/02* (2013.01); *H01R 4/70* (2013.01); *H01R 11/12* (2013.01); *H01R 12/707* (2013.01); *H01R 43/0207* (2013.01); *H01R 2103/00* (2013.01); *H01R 2201/26* (2013.01); *Y10T 29/49213* (2015.01)

(56) References Cited

U.S. PATENT DOCUMENTS

2004/0259406 A1* 12/2004 Yoshida ..... G01R 1/0466 439/331
2010/0066351 A1 3/2010 Condamin et al.
2011/0062945 A1 3/2011 Condamin et al.
2014/0327957 A1* 11/2014 Conolly ..... G02B 5/26 359/360

FOREIGN PATENT DOCUMENTS

| | | | |
|---|---|---|---|
| DE | 102006031839 | A1 | 1/2008 |
| DE | 102008051323 | A1 | 3/2010 |
| EP | 0361194 | A2 | 4/1990 |
| FR | 2879751 | A1 | 6/2006 |

OTHER PUBLICATIONS

Written Opinion of the International Searching Authority PCT/ISA/237 for International Application No. PCT/EP2013/052271 dated May 10, 2013.

* cited by examiner

CONNECTION OF A FIRST METAL COMPONENT TO A COVERED SECOND METAL COMPONENT

This application is the national phase under 35 U.S.C. §371 of PCT International Application No. PCT/EP2013/052271 which has an International filing date of Feb. 6, 2013, which designated the United States of America, which claims priority under 35 U.S.C. §119 to German patent application number DE 1020120078706 filed Apr. 18, 2012 and German patent application number DE 1020120035373 filed Feb. 26, 2012, the entire contents of each of which are hereby incorporated herein by reference.

FIELD OF THE INVENTION

Example embodiments relate to a connection of a first metal component to a covered second metal component. Example embodiments furthermore relate to a method for producing a connection of the above connection.

BACKGROUND

If moisture is allowed to reach the connection between the aforementioned components, which is usually produced by welding, a rapid corrosion of the aluminum must be feared which has a negative effect on the cable strength and thus the operational safety of the complete onboard power supply.

To be sure, attempts have previously been made to seal the connecting location between the components against moisture by using shrink-wrap hose and/or by using shrink-wrap hose/butyl strip seals and/or through insert-molding with polymers. These known sealing systems, however, cannot be used in practical operations for the temperature range of approximately −40° C. to approximately +230° C. and will therefore fail. Furthermore detrimental for a good sealing effect are the widely varying expansion coefficients of the materials used.

A method for covering micro-electric hybrid semiconductor circuits or micro-electronic semiconductor components is known from the DE 34 42 131 A1. With said method, the components located on a substrate are covered by pouring a soft, sealing layer of plastic over them, covering this layer with a compound foil of plastic and metal, and subsequently encapsulating it with synthetic resin. With this relatively involved method, a low-viscous, liquid elastomer is applied, for example, to form the soft sealing layer of synthetic material. A composite foil of plastic and metal is then placed onto this layer and is pressed against it with a hollow punch. A synthetic resin, especially a highly filled epoxy casting resin, is then used for the insert-molding or encapsulation.

A method for covering electric and electronic components or assemblies is known from the EP 0 361 194 A2, for which an intermediate layer of an elastic synthetic material is initially applied to the mechanically sensitive regions, which are then covered with an outer cover layer of a mechanically and chemically stable synthetic material. In the process, the outer covering layer as well as the intermediate layer are produced through injection-molding with molding compound in an injection molding tool. During the injection molding process, however, components to be encapsulated are subjected to relatively high pressure and temperature stresses.

The DE 10 2004 062 457 A1 discloses a water-absorbing composition with suppressed corrosiveness when in the swollen state, relative to copper, wherein its use is known for cable sheaths and for a sheathed cables.

SUMMARY

Example embodiments to provide an improved connection between components made of different metals.

Example embodiments relate to a first metal component, which may be a copper component, for example, while a second metal component, which may be an aluminum component, for example. For reasons of cost reduction and to save weight, aluminum cables are increasingly used in the field of automotive manufacturing. The cable ends may be generally provided with lugs made of copper or other metals which permit a fastening of the cables. When used in motor vehicles, cables of this type may be subjected to extreme stresses, for example, in particular to temperature changes, vibration stresses and the effects of moisture.

Extensive testing during practical operations has shown that the connection embodied according to example embodiments can withstand stresses caused by temperature changes in a temperature range between approximately −40° C. and +190° C., with strong mechanical vibration stress and high moisture over long periods of time. Even after subjecting the connection for many hours to a continuous temperature of 180° C. and temperature peaks of approximately up to 230° C., no failure of the connection could be detected. It can therefore be expected that when using the connection designed according to example embodiments, the operational safety can clearly be improved.

BRIEF DESCRIPTION OF THE DRAWINGS

An exemplary embodiment of the invention is explained in further detail in the following, with reference to the drawing.

Shown are in.

DETAILED DESCRIPTION OF EXEMPLARY EMBODIMENTS

Figure 1:
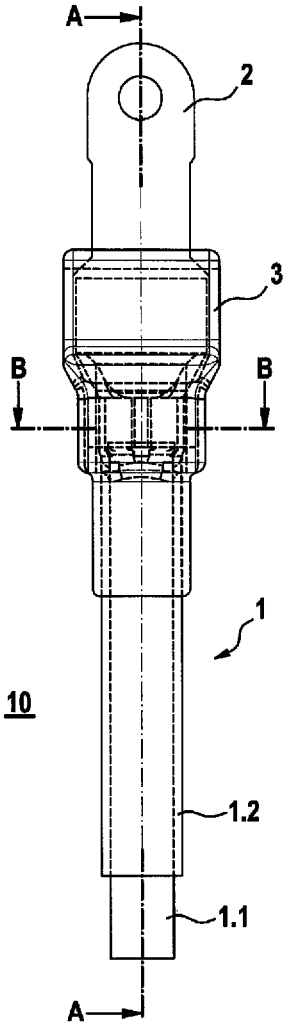
FIG. 1—a view from above of a manufactured cable.

The connection according to example embodiments is explained in the following with reference to the drawing and an exemplary embodiment in the form of a cable manufactured with a cable lug.

Figure 2:
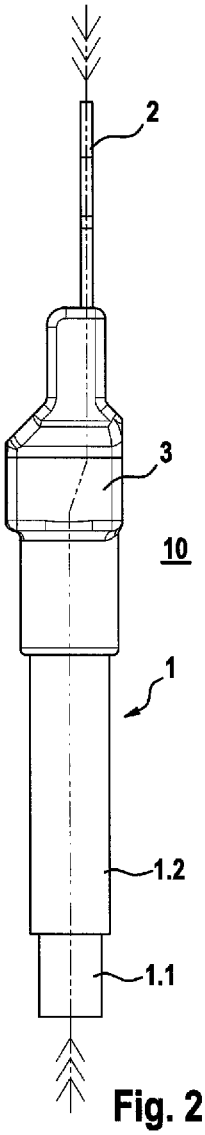
FIG. 2—a view from the side of a manufactured cable.

FIG. 1 shows a view from above of the cable 1 manufactured with a cable lug 2. FIG. 2 shows a view from the side of the cable illustrated in FIG. 1. The first metal component in this case is the cable lug 2, preferably consisting of copper or a copper alloy, which is advantageously covered with a contact layer of nickel phosphorous (NiP) that is not shown in further detail in the drawing. The second metal component within the meaning of the invention is a cable 1, consisting of a conductor 1.1 of aluminum that is encased in a sheath 1.2. The metal components 1 and 2 may be connected by a welded connection that is preferably produced through ultrasonic welding. The welding location may be enclosed with a sheath of insulating material 3 which, in some sections, also encloses the sheath 1.2 of the cable 1 and the cable lug 2.

Figure 3:
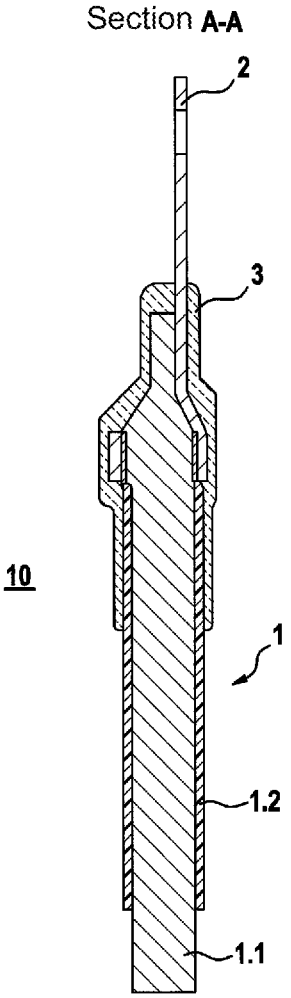
FIG. 3—a longitudinal section through the cable shown in FIG. 1.

FIG. 3 shows a longitudinal section through the finished cable 1, illustrated in FIG. 1.

Figure 4:
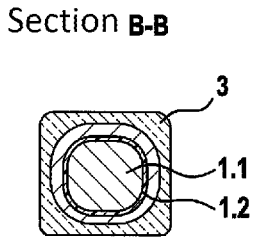
FIG. 4—a cross section through the cable shown in FIG. 1.

FIG. 4 shows a cross section through the finished cable 1, illustrated in FIG. 1.

An advantageous method for producing the connection according to example embodiments is described in the following with the aid of an example for producing a cable 1 with cable lug 2. The cable 1 may be an aluminum cable that is sheathed with a sheath 1.2 of a polyorganosiloxane, for example, high temperature vulcanization (HTV). The cable lug 2 may consist of copper, which is covered with a contact layer of nickel phosphorous (NiP), having a thickness of approximately 0.3 to 5 μm and, in particular, of 0.5 to 3 μm. In the connecting region, the conductor 1.1 of aluminum may be exposed by removing the silicon sheath 1.2. The cable lug 2 and the aluminum cable 1 may be preferably connected with the aid of ultrasonic welding. The silicon sheath 1.2 of the cable 1 may be first cleaned with cellulose and isopropanol. This is followed by a surface activation of the cable 1 in the connecting region and the cable lug 2 in an insulated atmospheric plasma. The connecting region may then be insert-molded in the connecting region with polyorganosiloxane (2k-LSR, liquid silicon rubber, 2 components), which is subsequently cross-linked at a temperature ranging from approximately 160° C. to approximately 210° C., in particular at a temperature ranging from approximately 170° C. to approximately 210° C.

Subsequent examinations of the connecting location have shown that the applied 2k silicon (LSR) has bonded with the 1k silicon (HTV) of the cable sheath, so as to advantageously form a permanent and durable, moisture resistant connection. An extraordinarily strong, moisture-resistant connection was also detected between the NiP layer of the cable lug and the applied 2k silicone following the cross-linkage.

While a number of example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

The invention claimed is:

1. A device for connecting between a first metal component and a second metal component covered by a sheath, comprising:

a partial region of the first metal component and a partial region of the second metal component, involving at least a section of the sheath, being respectively covered by an applied insulating layer; and a contact layer of nickel phosphorous (NiP) being applied to the first metal component, and the applied insulating layer being composed of polyorganosiloxane, wherein the first and the second metal component are joined by a welded connection, and subjected to an insulated atmospheric plasma, and wherein the insulating layer is insert-molded and is cross-linked by subjecting the insulating layer to heat.

2. The device of claim 1, wherein the first metal component is made of copper or a copper alloy.

3. The device of claim 1, wherein the sheath for the second metal component is composed of a polyorganosiloxane (HTV silicon).

4. The device of claim 1, wherein the polyorganosiloxane is a liquid silicon rubber (LSR).

5. The device of claim 1, wherein the first metal component is made of copper or a copper alloy.

6. The device of claim 5, wherein the second metal component is made of aluminum.

7. The device of claim 1, wherein the sheath for the second metal component is composed of a polyorganosiloxane.

8. The device of claim 7, wherein the polyorganosiloxane of the sheath for the second metal component is a high temperature vulcanization (HTV) silicon.

9. The device of claim 1, wherein the contact layer of NiP has a thickness of approximately 0.3 to 5 μm.

10. The device of claim 9, wherein the contact layer of NiP has a thickness of approximately 0.5 to 3 μm.

11. The device of claim 1, wherein the contact layer of NiP has a thickness of approximately 0.3 to 5 μm.

12. The device of claim 11, wherein the contact layer of NiP has a thickness of approximately 0.5 to 3 μm.

13. A method for producing a connection between a first metal component and a second metal component covered by a sheath, comprising:

covering the first metal component with a contact layer of nickel phosphorous (NiP);

connecting an end piece of the second metal component, with some sections of its sheath exposed and with an aid of a welded connection, to the first metal component;

cleaning a partial region of the cable sheath, that is to be insert-molded later on with an insulating material;

subjecting the connecting region, between the first and the second metal component, and the partial region of the cable sheath, to be insert-molded, to an insulated atmospheric plasma;

insert-molding the connecting region, and at least a partial region of the sheath around the cable, with an insulating material of a poly-organosiloxane; and cross-linking the insulating material through heating.

14. The method of claim 13, further comprising cleaning the partial region of the cable sheath with at least one of cellulose and isopropanol.

15. The method of claim 13, wherein the polyorganosiloxane is a liquid silicon rubber (LSR).

* * * * *